United States Patent [19]

Lebecque

[11] 4,183,597

[45] Jan. 15, 1980

[54] ELECTRICAL CONTACT SYSTEM

[76] Inventor: Maurice G. N. G. Lebecque, 9125 Wiltshire Pl., Burnaby, B.C., Canada, V3L 4N6

[21] Appl. No.: 922,032

[22] Filed: Jul. 5, 1978

[51] Int. Cl.[2] ..... H01R 39/00

[52] U.S. Cl. ..... 339/1 L; 339/20

[58] Field of Search ..... 339/1 R, 1 L, 20, 23, 339/182 L, 182 T, 183

[56] References Cited

U.S. PATENT DOCUMENTS

| | | | |
|---|---|---|---|
| 672,489 | 4/1901 | McAllister et al. | 339/1 L |
| 782,311 | 2/1905 | Zalinski | 339/20 X |
| 3,735,329 | 5/1973 | Funabashi et al. | 339/20 X |

*Primary Examiner*—Roy Lake
*Assistant Examiner*—DeWalden W. Jones
*Attorney, Agent, or Firm*—George J. Netter

[57] ABSTRACT

An electrical contact fixture is positionable on a surface and is connectable to the surface near a central portion. An electrically conducting continuous band extends around the central portion parallel to the surface. The band and the surface are connected by springs so that the band can be moved parallel to the surface when the fixture is connected to the surface. The fixtures can be stacked one upon the other and insulated from each other to provide terminals for electric currents and spaced at various distances from the surface. A collector has a resilient, elongate, serpentine portion for extending parallel to the surface. At least one collector contact is located along the serpentine portion. The collector contacts are in spaced-apart parallel relationship along the serpentine portion.

21 Claims, 9 Drawing Figures

ELECTRICAL CONTACT SYSTEM

BACKGROUND OF THE INVENTION

This invention relates to an electrical contact system.

Like the electrical contact system described in my U.S. Pat. No. 4,074,924, this invention finds application in a wide variety of electrical systems, for example systems in which a moving object, driven by electrical power, derives the power from a contact system beneath, about or above the route. Moreover, the contact system of the present invention is also applicable in static systems where it has the advantage that the system is independent of the fixed, prior positions of electrical outlets.

Electrical supply systems are well known in which the source of power is a contact rail alongside a fixed path, for example, as used in electrical railway systems, and particularly in underground electric rail systems or where a power collector collects the electricity from an overhead wire, for example, on certain railway systems on trolley buses and in factories. However, the disadvantage of putting the pick-up rail or track on the ground is clear whenever it may be contacted by a pedestrian. Systems in which overhead rails are used have the disadvantage that contact can be erratic. An example of this erratic contact is the trolley buses where the pick-up frequently breaks contact with the overhead wire, particularly at corners. The result is traffic delays while the contacts are moved back into their correct position on the overhead wires.

In existing static electrical systems, there is the disadvantage that appliances must be positioned near an outlet in the circuit. It is not desirable to move the appliance too far from the outlet since that would involve an excessively long lead. The only alternative is to introduce further outlets.

The present invention is also applicable to illuminated signs, particularly those where it is desired to convey a message in letters or numbers. At present, such signs are either limited to a single message dictated by fixed positions of the lights or, as seen at sports stadiums, highly complex wiring and circuitry, even computer controlled, is used to provide the capability of variable messages.

SUMMARY OF THE INVENTION

The present invention provides an electrical contact fixture positionable on a surface. The fixture comprises a central portion, the fixture being connectable to the surface near the central portion. A continuous peripheral electrical conductor extends around the central portion for positioning generally parallel to the surface. Means resiliently connects the peripheral conductor to the surface for movement of the peripheral conductor generally parallel to the surface when the fixture is connected to the surface. The means for resiliently connecting may comprise at least three compressible and extendible springs, each spring being connectable to the surface at a first end and connected to the peripheral conductor at a second end. The peripheral conductor may comprise a generally circular band.

According to another aspect of the invention, an electrical contact system comprises a plurality of the electrical contact fixtures located generally adjacent each other on the surface.

According to a further aspect of the invention, an electrical contact system comprises at least one set of generally like said electrical contact fixtures positionable one above another in a stack extending away from the surface. Each like fixture of a set includes set insulating means for insulating said each fixture from adjacent fixtures of the set.

The system may include a collector comprising a resilient, elongate, serpentine portion for extending parallel to the surface. The collector has collector contacts for contacting the peripheral conductors. The collector contacts are located along the serpentine portion in spaced-apart parallel relationship.

Like the invention disclosed in my earlier U.S. Pat. No. 4,074,924, the present invention provides an electrical contact system that permits easy relative movement of two parts, the electrical contact fixtures and the collector of the system. Excellent electrical contact is maintained whether the collector is moving over the surface at considerable speed, for example, a trolley bus or train, or whether the collector may be moved relatively infrequently, for example with an electrical appliance or illuminated sign. By affixing the fixtures in close proximity in any desired pattern on the surface, the collector can move along a wide variety of paths between the fixtures and transmit electrical current between the electrical contact fixtures and any equipment requiring electrical current. When compared with my invention disclosed in U.S. Pat. No. 4,074,924, the present electrical contact system provides the advantage of electrical contact fixtures which are movable to different positions on the surface instead of having the fixed embossments disclosed in my earlier patent. Additionally, there is no need to have an electrically conductive surface for the present invention and there is no need for the special base plate employed with my earlier invention.

In drawings which illustrate embodiments of the invention:

DESCRIPTION OF THE PREFERRED EMBODIMENTS

Figure 1:
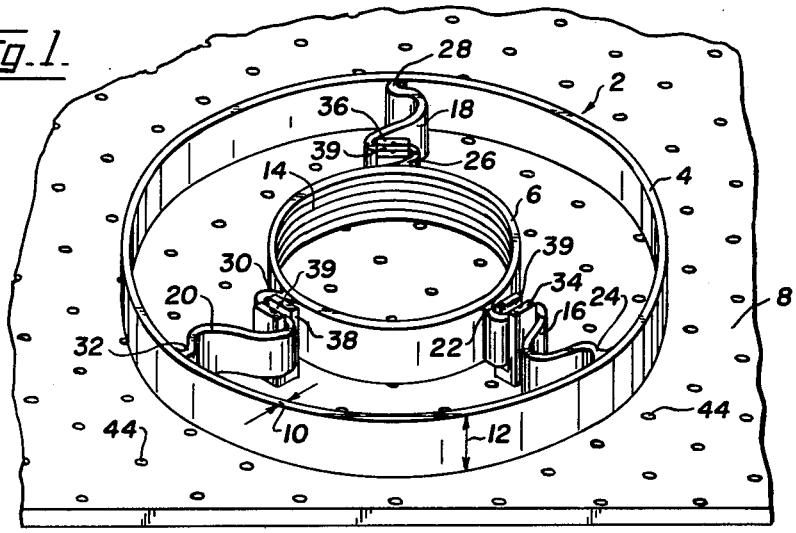
FIG. 1 is a perspective view showing an electrical contact fixture and a surface according to an embodiment of the invention.

FIG. 1 shows an electrical contact fixture 2 which provides a basic element of the present electrical contact system. Fixture 2 includes a circular band 4 providing a continuous peripheral electrical conductor extending around a central portion 6. Band 4 is a uniform metal band and is positioned parallel to a surface 8. The band 4 is thin in a dimension 10 parallel to the surface 8 relative to dimension 12 perpendicular to the surface 8.

The central portion 6 comprises a ring concentric with band 4 and includes an electrically conductive inner socket 14 electrically connected to band 4. Socket 14 is threaded for a light bulb or the like. Band 4 and central portion 6 are connected by three convoluted leaf springs 16, 18 and 20 extending in a generally radial direction from the central portion 6. Springs 16, 18 and 20 provide means for resiliently connecting the band 4 to the surface 8. While three leaf springs are shown, more than three leaf springs could be used, but at least three are required for proper support of band 4. Leaf springs 16, 18 and 20 are compressible towards central portion 6 and extendible away from central portion 6. Spring 16 has a first end 22 connected to the central portion 6 and a second end 24 connected to the band 4. Likewise, springs 18 and 20 have first ends 26 and 30 respectively and second ends 28 and 32 respectively.

Figure 3:
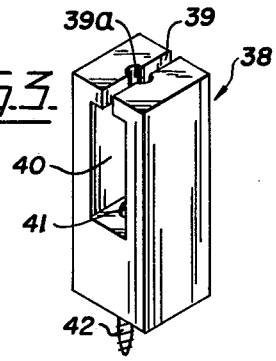
FIG. 3 is a perspective view of an insulator.

Electrical contact fixture 2 also includes three rectangular insulators 34, 36 and 38. Each of the insulators 34, 36 and 38 has a top slit 39 for fitting a leaf spring over the insulator. Insulators 34, 36 and 38 are all adjacent the central portion 6 and leaf springs 16, 18 and 20 pass through the central apertures 40 of insulators 34, 36 and 38 respectively as shown in FIG. 3. Insulators 34, 36 and 38 extend between the surface 8 and the springs 16, 18 and 20 respectively to insulate fixture 2 from surface 8 and to space the central portion 6 and the band 4 from the surface 8.

Insulators 34, 36 and 38 are provided with means for connecting the central portion 6 to the surface 8. This means is provided by apertures 41 in the insulators and screws 42 as shown in FIG. 3. Screws 42 fit within corresponding apertures 44 of surface 8. Apertures 44 are arranged randomly on surface 8 to provide the pattern necessary for proper positioning of the insulators. Of course, pegs, snaps, magnets and other similar means could be provided to connect the insulators to the surface. By means of the screws 42, fixture 2 can be fixedly connected to the surface 8. As band 4 is resiliently connected to the central portion 6 by convoluted leaf springs 16, 18 and 20, band 4 is movable in directions parallel to the surface 8 when the fixture 2 is connected to the surface 8.

Figure 2:
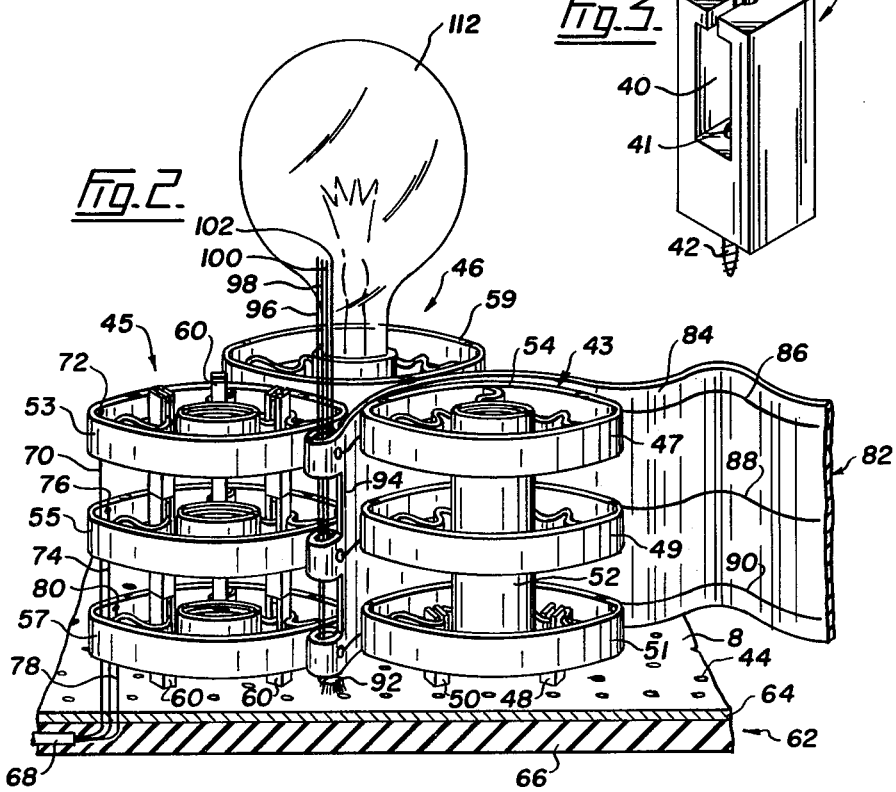
FIG. 2 is a perspective view showing three sets of three like electrical contact fixtures stacked one upon another, the sets being positioned adjacent each other on a surface, a collector and a light bulb within the central socket of one top fixture.

Referring to FIG. 2, it may be seen that a plurality of like fixtures 2 can be positioned one above the other in stacks, such as stacks 43, 45 and 46 extending away from the surface. 8. The stacks 43, 45 and 46 are positioned adjacent each other on the surface 8 and are normally in touching relationship. Of course, a plurality of fixtures 2 can be arranged adjacent each other on surface 8 without being stacked as shown in FIG. 2. The number of fixtures in each stack can be varied as required. Two different means for stacking the fixtures are illustrated in FIG. 2. Stack 43 includes three insulators, such as insulators 48 and 50 which are the same as insulators 34, 36 and 38 shown in FIG. 1. The insulators 48 and 50 are secured to surface 8 by means of screws 42 as shown in FIG. 3. However, instead of the ring-like central portion 6 shown in FIG. 1, an elongate tubular central portion 52 extends from the top to the bottom of the stack 43 joining all three fixtures 47, 49 and 51. Central portion 52 is of a suitable insulating material, such as plastic, so the individual contacts of stack 43 are insulated from each other. The interior of central portion 52 includes three separate threaded female sockets 54 for contacting, for example, the three threaded portions 56 of male member 58 shown in FIG. 4. Only the threaded female portion for the top fixture 47 is visible in FIG. 2. If desired, separate central portions 52 could be used for the three contacts 47, 49 and 51 in stack 43 with threads on the insulated portion or other means for stacking them to form an elongate central portion similar to central portion 52.

Stack 45 comprises fixtures 53, 55 and 57 and illustrates an alternative means for stacking the fixtures one above the other. Here, three elongate insulators 60 are provided each comprising three stacked insulators extending from surface 8 to the upper fixture 53 of stack 45. The leaf springs of each fixture pass through apertures in insulators 60 similar to aperture 40 in insulator 38 shown in FIG. 3. The insulators 60 separate and insulate the three fixtures 53, 55 and 57 of stack 45 from each other. The insulators stacked above other insulators are connected to the one below by screws 42 fitting in top apertures **39*a* shown in FIG. 3**.

Referring to FIG. 2, it may be seen that surface 8 comprises the upper surface of a flat board 62. Board 62 has an upper conducting layer 64 with the plurality of the apertures 44 already mentioned. The lower layer 66 of board 62 is of an insulating material. A power cable 68 passes through a suitable passageway in insulating layer 66 of board 62 from a source of electrical power. From cable 68, an insulated wire 70 is connected to the upper fixture 53 of stack 45 by a screw-type terminal 72. A second insulated wire 74 is connected to the middle fixture 55 by a screw-type terminal 76 and a third wire 78 is connected to the lower fixture 57 by a screw-type terminal 80. The upper fixtures 47, 53 and 59 of stacks 43, 45 and 46 respectively are normally in electrical contact with each other as are the middle fixtures of each stack and the lower fixtures of each stack.

A collector 82 is also shown in FIG. 2. Collector 82 has an elongate, resilient portion 84 comprising a wide flat band of a suitable insulating material such as polyethylene. The portion 84 must be stiff but resilient and is formed in a serpentine shape to help assure that collector 82 touches the fixtures as required. Collector 82 includes three collector contacts 86, 88, and 90. Collector contacts 86, 88 and 90 are parallel lengths of coiled copper wire affixed along serpentine portion 84 at distances to provide contact with the upper, middle and lower fixtures respectively of stacks 43, 45 and 46. A brush-type contact 92 is connected at the bottom of serpentine portion 84 at end 94. Brush contact 92 is for contacting surface 8 as shown in FIG. 2. A wire lead 96 is connected to contact 92, wire lead 98 is connected to contact 90, lead 100 is connected to contact 88 and lead 102 is connected to contact 86. In an alternative embodiments of the invention, surface 8 needn't include a conducting layer 64. In this case, brush contact 92 is replaced with any suitable means for contacting surface 8 and spacing collector contacts 86, 88 and 90 the proper distances from surface 8 to make contact with the upper, middle and lower fixtures respectively.

The electrical contact system shown in FIG. 2 is suitable for supplying three-phase electrical currents. The upper fixtures 47, 53 and 59 of stacks 43, 45, and 46 are normally in electrical contact and provide one terminal for the three-phase electrical current. Likewise, the middle contacts provide a second terminal and the lower contacts provide a third terminal. Surface 8 is used as a ground. The three-phase current is supplied through cable 68 to screw-type terminals 72, 76 and 80. Leads 98, 100 and 102 from collector 82 are used to supply the three phase current and lead 96 provides the ground.

Figure 4:
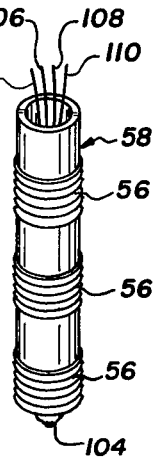
FIG. 4 is a perspective view of a male fitting having screw-type connectors for making electrical contact with the central sockets of one set of the electrical contact fixtures as shown in FIG. 2.

An alternative way of supplying, for example, a three phase current employs male member 58 shown in FIG. 4. Lead 105 is connected to bottom contact 104 for contacting surface 8 to provide a ground. Leads 106, 108 and 110 are connected to the upper, middle and lower threaded portions 56 for contacting the female threaded sockets of the upper, middle and lower fixtures of one of the stacks 43, 45 or 46 shown in FIG. 2. The male member is simply screwed through the sockets of one stack until contact 104 touches surface 8.

Figure 5:
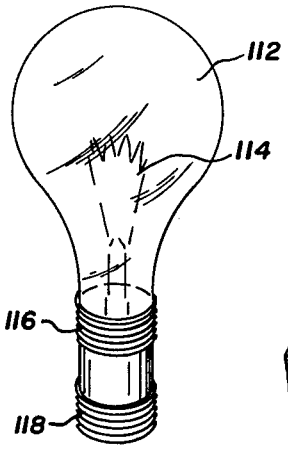
FIG. 5 is a perspective view of a special light bulb having a base with two spaced-apart screw-type connectors for making electrical contact with two adjacent fixture sockets as shown in FIG. 2 or FIG. 6.

FIG. 5 illustrates a special light bulb 112 with a filament 114 connected to upper and lower conductive base portions 116 and 118. Portions 116 and 118 can be threaded into sockets in the upper and middle fixtures of stacks 43, 45 or 46 shown in FIG. 2. Bulb 112 is illustrated in FIG. 2 as threaded into the upper and middle fixtures of stack 46. An ordinary light bulb could also be employed with a suitably adapted socket.

Figure 6:
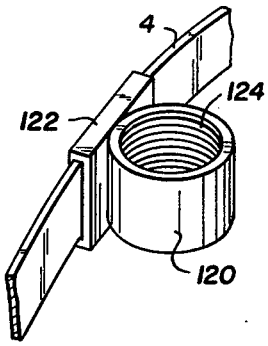
FIG. 6 is a perspective view of a female socket connected to a peripheral conductor.

An alternative socket 120 is shown in FIG. 6. Socket 120 is provided with a clip 122 for securing socket 120 on the inside of band 4 of a fixture. Socket 120 has an interior threaded portion 124. Sockets 120 can be placed one above the other on the bands of a stack of fixtures for supplying current to a male member 58 as shown in FIG. 4 or to a light bulb 112 as shown in FIG. 5.

Figure 7:
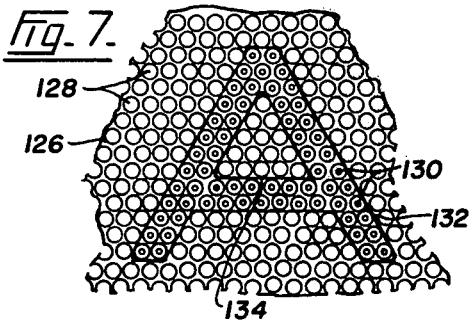
FIG. 7 is a side elevational view of a portion of a sign including a surface and a plurality of electrical contact fixtures as shown in FIG. 1.

FIG. 7 illustrates one application of a contact system as disclosed in the present invention. A board 126 is similar to board 62 of FIG. 2. A plurality of fixtures 128, similar to fixtures 2 shown in FIG. 1, are positioned on board 126 in touching relationship. Fixtures 128 have central portions, similar to central portion 6 in FIG. 1, secured to board 126 by screws 42 as shown in FIG. 2. Board 126 can have an upper conductive layer 64, as shown in FIG. 2, to provide one terminal for an electric current and fixtures 128 provide the second terminal for the electric current. Alternatively, a two-high stack of fixtures can be employed to provide two terminals for the electric current and board 126 can provide a ground. As a further alternative, the two terminals for an electric current can be supplied by two-high stacks of fixtures 128 and board 126 can be of an insulating material. A light bulb 130 is screwed into a socket in the central portion of each fixture 128. In order to display the letter "A", a band of insulating material 132 is used to separate and insulate the fixtures 128 in the shape of the outside of the letter A. Likewise, insulating material 134 is used to separate fixtures 128 in a shape of a triangular interior aperture of the letter A. In order to illuminate the letter A, it is simply necessary to provide electrical current to fixtures 128 between insulation 134 and 132. This can be done by means of a cable and screw terminals similar to those shown in FIG. 2. The fixtures 128 inside insulation 134 and the fixtures 128 outside insulation 132 are electrically insulated from the current. Consequently, only the bulbs 130 between the insulation 132 and 134 in the shape of the letter "A" will be illuminated by the electrical current. Of course, FIG. 7 only illustrates a portion of a sign and a much larger number of fixtures 128 are required to illuminate the required message. The message may be changed at any time by changing the pattern of insulation to illuminate different bulbs. The fixtures 128 needn't be of uniform size or arranged in uniform rows as illustrated in FIG. 7.

Using a plurality of fixtures 128 arranged on a board 126 as shown in FIG. 7 or, alternatively, using stacks of fixtures, a collector 82 as shown in FIG. 2 can travel between fixtures 128 to provide a moving source of electrical current. Alternatively, collector 82 can provide a stationary collector at any desired position on board 126. Because of its serpentine shape and elongate collector contacts 86, 88 and 90, collector 82 is certain to make contact with the fixtures 128 regardless of its stationary position and regardless of its position while travelling a desired path on board 126 between fixtures 128.

Figure 8:
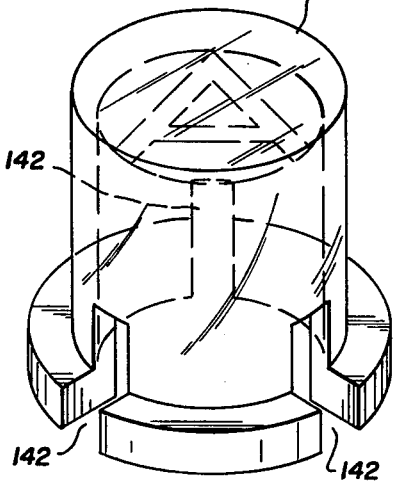
FIG. 8 is a perspective view of a translucent cover for a contact fixture.

FIG. 8 shows a cover 140 adapted for fitting over the central portion of an electrical contact fixture such as central portion 6 of fixture 2 shown in FIG. 1. The three slots 142 are provided at the bottom of the cover 140 for fitting over insulators such as insulators 34, 36 and 38 of FIG. 1. If the cover 140 is translucent, it may be used to protect a light bulb in socket 14 and to diffuse the light therefrom.

Figure 9:
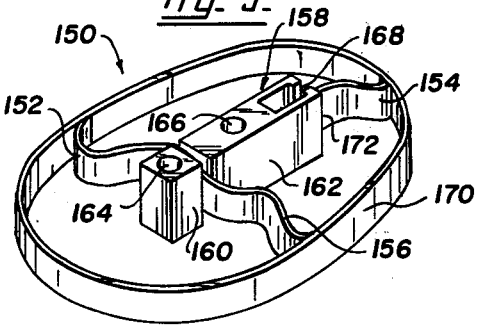
FIG. 9 is a perspective view of an alternative electrical contact fixture.

FIG. 9 illustrates an alternative electrical contact fixture 150 similar in principle to that shown in FIG. 1. Fixture 150 is oval-shaped instead of being circular, and has three leaf springs 152, 154 and 156. The central portion 158 comprises two parts 160 and 162 of an insulating material provided with apertures 164 and 166 for screws to connect the parts to a surface. The ends of springs 152 and 156 distal the band 170 are retained between parts 160 and 162. The corresponding end of spring 154 is retained within slot 168 communicating with end 172 of part 162.

What I claim is:

1. An electrical contact fixture positionable on a surface and comprising:

a central portion, the fixture being connectable to the surface near the central portion;

a continuous peripheral electrical conductor extending around the central portion for positioning generally parallel to the surface; and means for resiliently connecting the peripheral conductor to the surface for movement of the peripheral conductor generally parallel to the surface when the fixture is connected to the surface.

2. A fixture as claimed in claim 1 wherein the means for resiliently connecting comprises at least three compressible and extendible springs, each spring being connectable to the surface at a first end and connected to the peripheral conductor at a second end.

3. A fixture as claimed in claim 1 or claim 2, the peripheral conductor comprising a uniform metal band which is thin in a dimension parallel to the surface relative to a dimension perpendicular to the surface.

4. A fixture as claimed in claim 2, the springs comprising convoluted leaf springs extending in a generally radial direction from the central portion.

5. A fixture as claimed in claim 4, the peripheral conductor comprising a generally circular band.

6. A fixture as claimed in claim 1 comprising surface insulating means positionable between the fixture and the surface.

7. A fixture as claimed in claim 4, comprising surface insulating means connected to fixture generally adjacent the central portion and positionable between the springs and the surface to space the central portion and the conducting means a distance from the surface and to insulate the fixture from the surface.

8. A fixture as claimed in claim 7, the surface insulating means comprising a plurality of insulators with a central aperture, each leaf spring extending through the central aperture of one of the insulators.

9. A fixture as claimed in claim 8, the central portion comprising a socket for a light bulb.

10. An electrical contact system comprising a plurality of the electrical contact fixtures as claimed in claim 2, located generally adjacent each other on the surface.

11. An electrical contact system as claimed in claim 10, the surface being electrically conductive and comprising a first terminal for an electrical current, the fixtures comprising a second terminal for the electrical current.

12. An electrical contact system as claimed in claim 10, comprising at least one set of generally like said electrical fixtures one above another in a stack extending away from the surface, each said like fixture of a set including set insulating means for insulating said each fixture from adjacent fixtures of the set.

13. An electrical contact system as claimed in claim 12, the set insulating means spacing apart the fixtures in a direction perpendicular to the surface.

14. An electrical contact system as claimed in claim 13, the set insulating means comprising a plurality of set insulators, each with a central aperture and being located adjacent the central portion of a fixture, each said means for resiliently connecting the conducting means to the central portion extending through the central aperture of one said set insulator.

15. An electrical contact system as claimed in claim 14, each said like fixture comprising a terminal for an electrical current.

16. An electrical contact system as claimed in claim 11, including at least one collector for conducting electrical current and including at least one collector contact for contacting the surface and at least one collector contact for contacting a peripheral conductor.

17. An electrical contact system as claimed in claim 12 including at least one collector for conducting an electrical current and including a plurality of said fixtures, each collector having a collector contact for contacting peripheral conductors spaced generally a given distance from the surface.

18. An electrical system as claimed in claim 17, the collector contacts for contacting the peripheral contacts spaced the given distance from the surface being elongate for positioning generally parallel to the surface and generally the given distance from the surface when the collector is in position for use.

19. An electrical contact system as claimed in claim 18, the collector comprising a resilient, elongate, serpentine portion for extending parallel to the surface, the collector contacts for contacting the peripheral conductors being located along the serpentine portion in spaced-apart parallel relationship.

20. An electrical contact system as claimed in claim 12, the central portion of the fixtures comprising sockets for light bulbs and one terminal for an electrical current, the sockets for the like fixtures of each set being generally concentric when the like fixtures are stacked upon one another.

21. An electrical contact fixture as claimed in claim 1 comprising a cover for the central portion.

* * * * *